US007080921B2

(12) United States Patent
Feldstein

(10) Patent No.: US 7,080,921 B2
(45) Date of Patent: Jul. 25, 2006

(54) LINEAR LIGHT USING LEDS

(75) Inventor: Robert S. Feldstein, Yonkers, NY (US)

(73) Assignee: Argent Electric, Inc., Chappaqua, NY (US)

( * ) Notice: Subject to any disclaimer, the term of this patent is extended or adjusted under 35 U.S.C. 154(b) by 152 days.

(21) Appl. No.: 10/777,591

(22) Filed: Feb. 13, 2004

(65) Prior Publication Data

US 2005/0180133 A1 Aug. 18, 2005

(51) Int. Cl.
*F21S 4/00* (2006.01)

(52) U.S. Cl. ..... 362/219; 362/235; 362/241; 362/249

(58) Field of Classification Search ..... 362/219, 362/241, 244–247, 331, 800, 551, 558; 257/98; 313/512
See application file for complete search history.

(56) References Cited

U.S. PATENT DOCUMENTS

| | | | | |
|---|---|---|---|---|
| 5,418,384 | A * | 5/1995 | Yamana et al. | 257/88 |
| 5,613,758 | A | 3/1997 | Kamschal et al. | |
| 5,785,404 | A * | 7/1998 | Wiese | 362/555 |
| 6,173,517 | B1 | 1/2001 | Eibner et al. | |
| 6,530,465 | B1 | 3/2003 | Lauch | |
| 2002/0006039 | A1 | 1/2002 | Hiroshi et al. | |
| 2003/0095399 | A1 | 5/2003 | Grenda et al. | |
| 2003/0174517 | A1 | 9/2003 | Kiraly et al. | |

* cited by examiner

*Primary Examiner*—Thomas M. Sember
*Assistant Examiner*—Adam C. Rehm
(74) *Attorney, Agent, or Firm*—Eliot Gerber

(57) ABSTRACT

A lighting fixture provides a substantially uniform line of light (bar of light) for illumination or signage. It uses a linear array of LEDs (light-emitting diodes) which are relatively efficient, long-lasting and resistant to damage from vibration. The LEDs are arranged within a reflective shell within the fixture and one or more elongated cylindrical focusing lenses are positioned at a specific distance in front of the LEDs to focus the light into a line of light. A focusing lens may also be the protective window of the reflective shell.

13 Claims, 3 Drawing Sheets

LINEAR LIGHT USING LEDS

The present invention relates to illuminating light fixtures and more particularly to light fixtures producing a line of light, i.e., a light bar using LEDs (light emitting diodes) as their light source.

BACKGROUND OF THE INVENTION

At the present time various types of lighting fixtures and devices are used when a line of light is desired for illumination. Such lighting is sometimes called a "light bar" or "light line" or "linear lighting" or "strip lighting" or "one dimension lighting".

For example, fluorescent bulbs and neon lighting each may provide an elongated strip of light. Such light, especially neon lighting, is widely used is signs. However, both neon and fluorescent lighting are limited in certain applications and in difficult environments, such as sites if high vibration or frequent physical shocks.

LEDs (Light Emitting Diodes) are semiconductor electronic devices which convert electric energy into electromagnetic radiation at visible or near-infrared frequencies when their pn junctions are forward biased. Compared to gas-filled tubes, i.e. neon or fluorescent bulbs, for illumination they are physically sturdy and long-lasting. For these reasons, LEDs are frequently used in signs, such as EXIT signs, and in traffic signals, such as RED/AMBER/GREEN traffic lights. In addition, LEDs are sometimes used for low light illumination using battery power, in such uses as PDAs, cellular telephones and warning signs.

In one particular application, that of escalator "step off" light, fluorescent lighting has become the common light source although it has serious shortcomings. In this application illumination is required through the last tread of an escalator's moving stairway. It is often written into building codes. A fluorescent fixture is located beneath the face of the moving escalator stair and its light shines through the comb-like bars of the stairs as a warning. The constant vibration of the escalator tends to seriously shorten the life of the fluorescent bulbs. The bulbs themselves are inexpensive but the down-time and labor required to replace such bulbs at these difficult locations behind the stair face makes such lighting expensive.

Various United States patents and patent applications relate to the use of LEDs as a linear light and their use in escalator illumination. In U.S. Pat. No. 6,623,151 to Peterson an LED double light bar is used as a warning signal light. In U.S. Patent Application 20030095399 to Code et al, an LED is mounted in a fixture having reflective walls and a diffuser, the fixture having flat end surfaces so they may be placed end-to-end to create a light bar. In U.S. Pat. No. 6,173,517 to Eiber et al, a light line consists of a series of surface-mounted devices (SMD) which are LEDs. In U.S. Patent Application 20020006039 to Kind et al, a plural LED light source is formed by a mirror reflector, an ellipse or a parabola, for linear illumination. In U.S. Patent Application 20030174517 to Kiraly et al., LED printed wire board segments within a lighting fixture form a light line. The fixture includes a linear reflecting mirror and a window. U.S. Pat. No. 6,530,465 to Laych relates to an escalator having LEDs and polymer light pipes to illuminate escalator stairs for safety. In U.S. Pat. No. 5,613,758 to Kamschal et al., an escalator at selected points is illuminated by glass fiber optical conductors. The above-mentioned patents and patent applications are incorporated by reference herein.

DETAILED DESCRIPTION OF THE INVENTION

Figure 1:
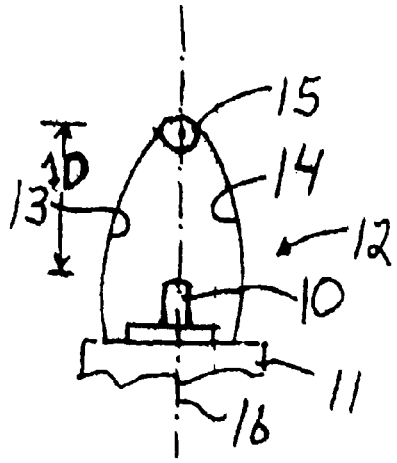
FIGS. 1, 2, 3, 4 and 5 are sketches illustrating devices and arrangements used in the present invention

As shown in the embodiment of the present invention shown in the side view of FIG. 1, a series of LEDs (Light Emitting Diodes) (10) are aligned in a line (linear array/row) on a base (11) of an enclosure (fixture). A reflector (12) having opposite walls (13 and 14) reflects light ("belt line light"). An elongated cylindrical lens (15) is positioned in air space at a distance preferably of at least one diameter ("1D") away from the top surfaces (the tips) of the LEDs and along the desired optical light path (16) (optical axis of the LEDs). Preferably the lens (15) is a clear (transparent) plastic polymer lens, for example, of "Lucite" (TM of DuPont), "Lexan" (TM of General Electric) or acrylic (PMMA). The dimension "D" (distance) refers to the distance between the LEDs constituting the linear array and the cylindrical rod, and not to the diameters of the LEDs themselves.

Preferably, the LEDs have a narrow light exit angle (effective emission) and they are clear (not colored). This embodiment is especially useful in direct lighting (illumination).

Figure 2:
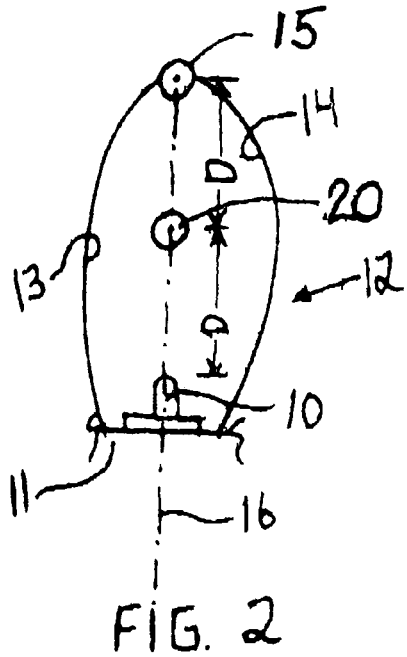

The embodiment of FIG. 2 is similar to that of FIG. 1, except an additional elongated cylindrical rod lens (20) is positioned in the optical path (16). This additional lens may be used as an additional focusing lens, to sharpen the line of light. The lens (15) may be used to obtain diffusion (depixilation). One or both of its surfaces may be frosted (slightly textured) or may have internal granular material to scatter the incident light. The lens (15) is preferably at a distance 1.5D to 2.5D, and most preferably 2D from lens (20).

Figure 3:
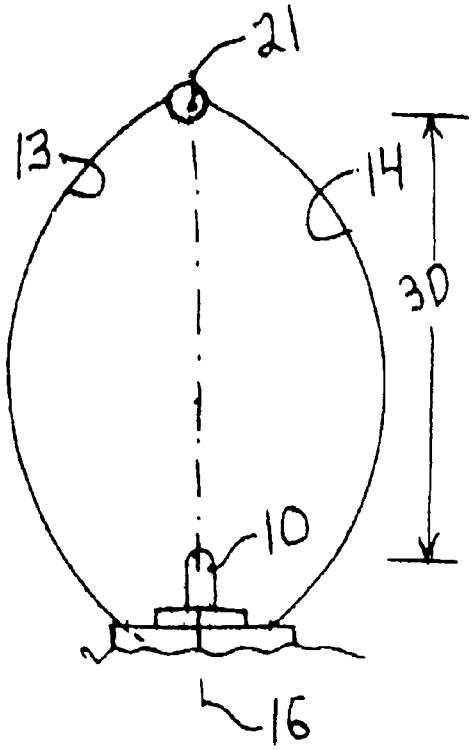

In the embodiment of FIG. 3, a cylindrical rod lens (21) is placed at a distance preferably 2.5D to 3.5D and most preferably 3D above the LEDs (10). The spacing of the lens (21) from the LEDs (10) controls the focus, and therefore, the exit angle of the light from the LEDs (10). The lens (21) is clear (transparent) and provides a highly pixilated (non-uniform) line of light. This embodiment preferably used to maximum efficiency, i.e., the most light output from the light emitted by the LEDs (10) which preferably has a small effective emission angle, combined with a fairly bright output, i.e., a fan-shaped beam of emitted light. This embodiment is especially adapted for use as an area illuminator. It provides illumination of an egress path, for example on an emergency fire stairwell in a building. This type of evacuation light may be automatically activated during an electric power failure or interruption. Generally such emergency lights use fluorescent or incandescent bulbs and are required to stay lit for only 90 minutes (as specified by U.L Underwriters Laboratory Standard 924). However, the embodiment of FIGS. 6 and 7, using LEDs, will operate for at least 24 hours on the same battery power at a reduced light output compared to 90-minute emergency lights. In the past years, in cities worldwide, electric power has failed for longer than 90 minutes. A row of linear lighting of the type of the embodiment of FIGS. 6 and 7, and having a battery, battery charger and control switch responsive to loss of AC, may be used in addition to conventional emergency lights to provide a "last resort" illumination during prolonged blackouts.

Embodiments of the present linear light may be used in various decorative and sign applications. For example, a linear light of the embodiment of FIG. 1 may use a frosted and/or textured rod lens (15), or the embodiment of FIG. 2, similar to that of a neon bulb but avoiding the high-voltage transformer and noise of neon lighting. The double rod lenses of the embodiments of FIGS. 2, 6 and 7 may be used as a lighted line with a small viewing angle, such as a ceiling line of lights in a theater or concourse, flashing (alternating) lights on an emergency vehicle or construction barrier flashing warning lights.

Figure 4:
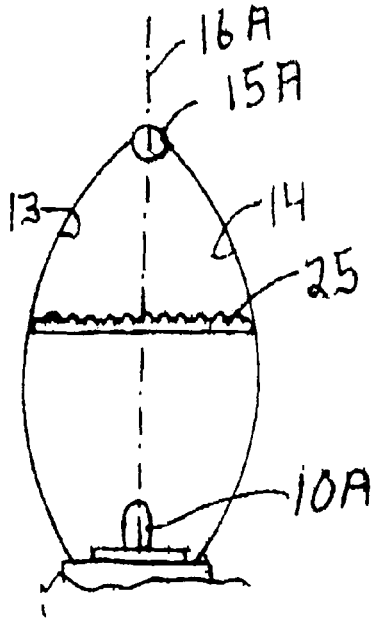
Figure 5:
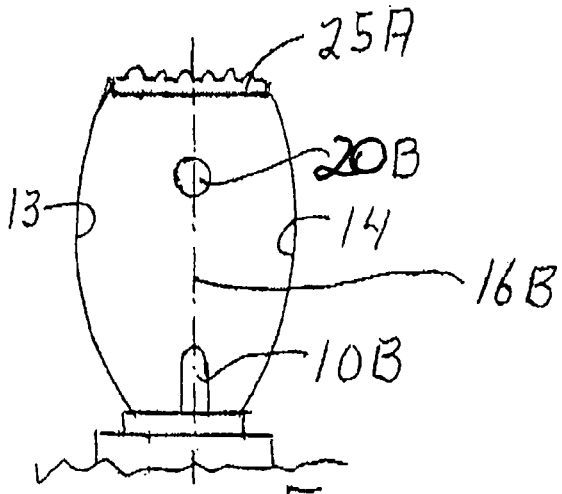

A lenticular array is a sheet, usually of a clear plastic polymer, having parallel rows of elongated cylindrical lenses (see FIG. 4). For example, lenticular arrays having 142 lenses per inch are available from Edmunds Optical. Such a lenticular array (25) is used in the embodiment of FIG. 4. It is positioned perpendicular to optical axis (16A) and between the LED row array (10A) and the elongated focusing lens (15A) which in this case may be clear or textured. In the embodiment of FIG. 5, a lenticular array (25A) is positioned perpendicular to optical axis (16B) of LEDs (10B) and after the focusing lens (20B). In this embodiment the lenticular array may be a rigid or semi-rigid plate and may be the protective window of the light fixture or LED shell reflector.

Figure 7:
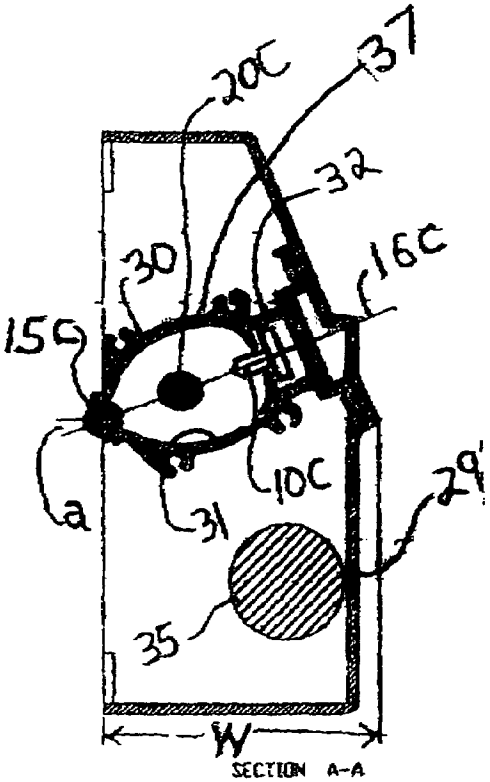
FIG. 7 is a side view, taken along A—A of FIG. 6.
Figure 6:
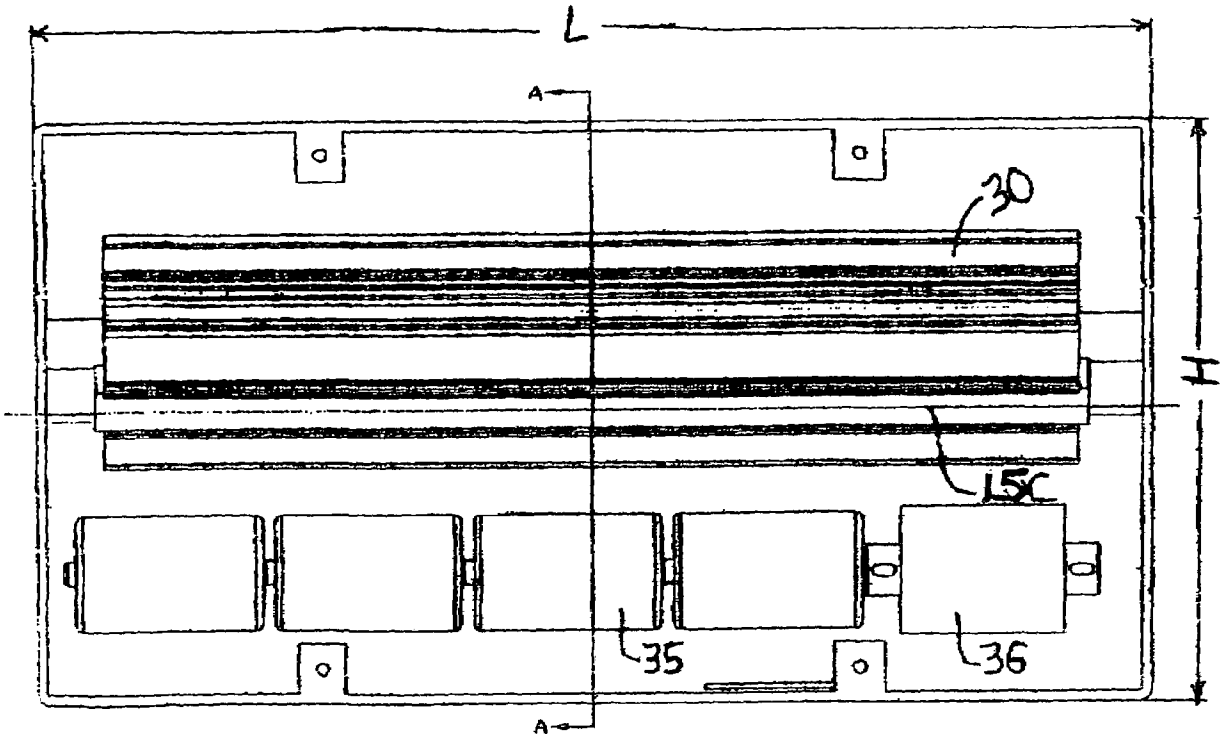
FIG. 6 is a front view of a preferred embodiment of the invention.

The embodiment shown in FIGS. 6 and 7, which is a 24-hour auxiliary light, the optical assembly (30) is preferably an elongated generally U-shaped member of extruded aluminum or molded plastic resin. It has an internal reflector (31) having opposite internal reflective walls (interior surface of 30) forming the reflector. Preferably these walls formal an optical trap and may be treated to form an optical reflector.

If the LEDs are properly selected, most of the light they generate will impinge on the first focusing rod lens (20C), with a beam of less than 15 degrees centered on the optical axis (16C). Each LED will have its own optical axis but will be parallel to each other and, for the purpose of analysis, will be treated as on optical axis. However, some light ("belt line light") will be radiated at the plane of the LEDs and will be outside of the beam. The function of the reflector is to capture such light and direct it to the bottom (inlet face) of the second focusing rod lens (20C). As mentioned above, the preferred curvature of the reflector as seen in the side view as in FIG. 7 is an effective optical trap, but an ellipse, alternatively, may be used. The curvature, preferably being parallel to the LEDs, curves to provide multiple internal reflections with the light, after losses, exiting the shell through the exit focusing rod lens (15C).

The row of LEDs (10C) is fixed to the base (32) of shell (30) and the shell is mounted on the fixture (29). This embodiment follows the principles of the embodiment of FIG. 1 and has a lens rod (15C) which forms a sealed window of the shell (30). A series preferably of four 1.5 volt batteries (35) are mounted within the fixture (29) and are connected in conventional fashion, through control switch (36) to automatically power the LEDs (10C) upon the stoppage of AC power. In this embodiment, in one prototype having 6 LEDs, the emission angle, taken from the optical axis (16C) was 12 degrees, so that the total illumination line width was 24 degrees. In the aforesaid prototype of FIGS. 6 and 7 the length "L" is 342.9 mm (13.5 inches) an d the width "W" is 80.45 mm (3.17 inches) and the height "H" is 177.8 mm (7.0 inches). The length of the shell (30) is 292.9 mm (11.5 inches) and the distance "D" between the 6 evenly-spaced LEDs is 41.7 mm (i.64 inches).

In the prior description it is assumed that the LEDs are white and the focusing cylindrical lenses are clear (transparent). However, the light line may be colored by using colored LEDs, for example, red, green, blue or amber, or by using colored lenses. The final appearance of the light line may also be controlled by using various surface effects on the lenses, such as texture, cross-hatching or other patterns.

The position of the lenses contributed toward determining the width of the linear light, which is measured by the exit angle of the final lens.

Figure 8A:
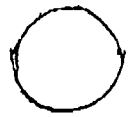
FIGS. 8A, 8B, and 8C are cross-sectional views of alternative elongated lenses which may be used in the present invention.
Figure 8B:
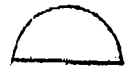
Figure 8C:
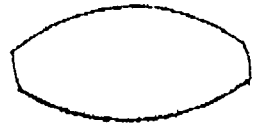
Figure 9:
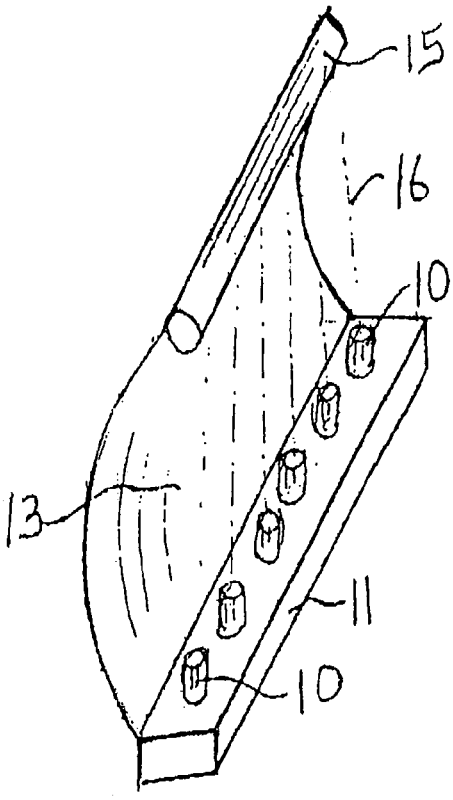
FIG. 9 is a perspective view of the preferred embodiment of the invention as shown in FIG. 6.

As shown in FIG. 8A the cylindrical lens rods such as rods (15), (15A), (15C), (20), (20B) and (20C) may be round, which is equivalent to a convex-convex lens, or, as in FIG. (8B), they may be half-round shape, which is equivalent to a simple convex lens, or they may be an oblong shape as in FIG. (8C), which is equivalent to a modified convex-convex lens.

What is claimed is:

1. A lighting fixture to illuminate a line of light, the lighting fixture comprising:

(a) a base, (b) a plurality of at least three LEDs (Light Emitting Diodes) mounted on the base, the LEDs being aligned sequentially in a line;

(c) a first elongated rod focusing lens spaced from and parallel to the LEDs and adapted to focus light into a line of light; and (d) a second elongated rod focusing lens, spaced from and parallel to the first focusing lens and adapted to focus light onto the first focusing lens; and (e) a reflector extending from the base to the first focusing lens, said reflector comprising two opposite curved walls having reflective surfaces.

2. A lighting fixture as in claim 1 wherein the LEDs are uniformly spaced, the spacing from the LEDs to the second focusing lens being in the range of 0.5D to 1.5D and the distance between the first focusing lens and the LEDs being in the range of 2.5D to 3.5D.

3. A lighting fixture as in claim 1 wherein the LEDs are aligned in a straight row and are separated from said second lens by only an air gap.

4. A lighting fixture as in claim 1 wherein each of the lenses is selected from the group consisting of:

transparent rods, colored translucent rods, rods with surface treatment to diffuse light and rods with internal materials to diffuse light.

5. A lighting fixture to illuminate an egress path in an emergency with a line of light, the lighting fixture comprising:

(a) a base, (b) a plurality of at least three LEDs (Light Emitting Diodes) mounted on the base, the LEDs being aligned sequentially in a line;

(c) a first elongated rod focusing lens spaced from and parallel to the LEDs and adapted to focus light into a line of light;

(d) a second elongated rod focusing lens spaced from and parallel to the first focusing lens and adapted to focus light onto the first focusing lens;

(e) a battery; and (c) a switch which electrically connects the battery to energize the LEDs upon loss of AC power.

6. A lighting fixture as in claim 5 and the fixture also comprising a reflector extending from the base to the first focusing lens.

7. A lighting fixture as in claim 5 wherein the reflector comprises two opposite curved walls having reflective surfaces.

8. A lighting fixture as in claim 5 wherein the LEDs are uniformly spaced, and the spacing from the LEDs to the second focusing lens being in the range of 0.5D to 1.5D and the distance between the first focusing lens and the LEDs being in the range of 2.5D to 3.5D.

9. A lighting fixture as in claim 5 wherein the LEDs are aligned in a straight row.

10. A lighting fixture as in claim 5 wherein each of the lenses is selected from the group consisting of:

transparent rods, colored translucent rods, rods with surface treatment to diffuse light and rods with internal materials to diffuse light.

11. A lighting fixture as in claim 9, the fixture, further comprising the second elongated focusing lens being positioned between the first lens and the LEDs and being a straight rod.

12. A lighting fixture as in claim 5 wherein the battery is rechargeable and the fixture includes a battery charger.

13. A lighting fixture as in claim 12 wherein the lenses are glass or polymer plastic straight rods and the LEDs are aligned in a straight row.

* * * * *